United States Patent [19]

Kaarre

[11] Patent Number: 4,848,448

[45] Date of Patent: Jul. 18, 1989

[54] HEAT EXCHANGE ASSEMBLY

[75] Inventor: Norman J. Kaarre, Sioux Falls, S. Dak.

[73] Assignee: McCord Heat Transfer Corporation, Walled Lake, Mich.

[21] Appl. No.: 137,960

[22] Filed: Dec. 28, 1987

[51] Int. Cl.[4] ..... F28F 9/02

[52] U.S. Cl. ..... 165/158; 165/173; 285/382; 29/157.4; 29/511

[58] Field of Search ..... 165/158, 173; 285/382; 29/511, 510, 157.3 R, 157.4

[56] References Cited

U.S. PATENT DOCUMENTS

| | | | |
|---|---|---|---|
| 2,457,633 | 12/1948 | Borg | 285/382 X |
| 2,805,591 | 9/1957 | Widmer | 285/382 X |
| 2,867,358 | 1/1959 | Meshberg | 29/511 X |
| 3,360,847 | 1/1968 | Chick et al. | 29/511 X |
| 3,363,680 | 1/1968 | Baker | 165/158 |
| 3,434,194 | 3/1969 | Whittaker et al. | 29/507 X |
| 3,509,916 | 5/1970 | Mercier | 29/511 X |
| 3,948,315 | 4/1976 | Powell | 165/158 X |
| 4,305,459 | 12/1981 | Nonnemman | 165/173 |
| 4,331,201 | 5/1982 | Hesse | 165/153 |
| 4,351,390 | 9/1982 | Argyle et al. | 165/154 X |
| 4,360,060 | 11/1982 | Collgon | 165/173 |
| 4,461,157 | 8/1983 | Cadars | 165/173 |
| 4,485,867 | 12/1984 | Melnyk | 165/173 |
| 4,546,823 | 10/1985 | Melnyk | 165/149 |
| 4,600,051 | 7/1987 | Wehrman | 165/173 |

*Primary Examiner*—Robert E. Garrett
*Assistant Examiner*—Carl D. Price
*Attorney, Agent, or Firm*—Reising, Ethington, Barnard, Perry & Milton

[57] ABSTRACT

A heat exchange assembly (10) includes an outer shell (12) and a cap member (26) disposed within the end portion (16) of the shell (12). The cap member (26) is fixedly connected within the end portion (16). A gasket (34) perfects a fluid tight seal between the shell (12) and the cap member (26). The cap member (26) includes a radially outwardly projecting protrusion having an outer surface (36,38). The gasket (34) is disposed about the protrusion. The end portion (16) of the shell (12) is crimped around the protrusion for preventing axially inward and outward movement of the cap member (26) relative to the shell (12) and compressing the gasket (34) against the outer surface (36,38) of the protrusion.

5 Claims, 1 Drawing Sheet

HEAT EXCHANGE ASSEMBLY

TECHNICAL FIELD

This invention relates generally to heat exchangers and, more particularly, to heat exchangers including a shell and cap member joined together without the use of soldering or welding.

BACKGROUND ART

Various techniques have been used to connect either header plates or cap members to shells of heat exchangers without the use of soldering or welding. For example, the U.S. Pat. Nos. 4,360,060 to Collgon, issued Nov. 23, 1982, and 4,485,867 to Melnyk et al, issued Dec. 4, 1984, disclose heat exchangers of the type including rows of tubes and a pair of headers secured to the ends of the tubes by the headers being crimped around the end of the shell or housing member. In the Melnyk et al patent, a tank is lowered onto a header and gasket such that a blunt-nosed edge is adapted to force the center portion of the gasket into a depression formed in the bottom of the center of grooves in the header. Once the tank is positioned in this manner, the peripheral wall portions of the header member is folded over onto a ledge on the tank. In the Collgon patent, the peripheral edge of the cap member has a U-shaped edge when viewed in cross section for fitting over a water box.

The U.S. Pat. Nos. 4,305,459 to Nonnenmann et al, issued Dec. 15, 1981 and 4,600,051 to Wehrman, issued July 15, 1987, disclose heat exchangers having solderless connections wherein a gasket is clamped between the flat faces of a edge of a tank and a substantially U-shaped portion of a cap member, the U-shaped portion of the cap member being crimped around an expanded edge of the tank.

The U.S. Pat. Nos. 4,331,201 to Hesse, issued May 25, 1982, and 4,546,823 to Melnyk, issued Oct. 15, 1985 and assigned to the assignee of the present invention, disclose a solderless clamp connection for a heat exchange type assembly wherein a housing is clamped to a header by corrugated interlocking tabs.

It remains desirable to provide a solderless and weldless connection in order to save costs. However, it is desirable to provide a connection of much simpler construction than the prior art while continuing to perfect a seal between the shell or housing of the heat exchanger and the end of the cap member. Further, it is desirable to perfect a seal between the cap member and the header member in an assembly wherein a header is disposed within the shell or housing for supporting a plurality of tubes therein and a cap member is disposed over the end of the housing.

An additional consideration is the use of material having different coefficients of thermal expansion to comprise the shell and heat exchange elements. In an assembly that has been soldered, brazed, or welded any difference in thermal expansion or contraction places undue stresses upon the components and joints. The present invention provides means for absorbing the differences in rate of thermal expansion of the heat exchange element and the outer shell.

SUMMARY OF THE INVENTION

In accordance with the present invention, there is provided a heat exchange assembly including an outer shell having an internal passageway defining a longitudinal axis and having an end portion. A cap member is disposed within the end portion. The shell includes connecting means for fixedly connecting the cap member within the end portion. Gasket means perfects a fluid tight seal between the connection means and the cap member. The cap member includes a radially outwardly projecting protrusion having an outer surface. The gasket means is disposed about the protrusion. The connecting means includes an end portion crimped around the protrusion for preventing axially inward and outward movement of the cap member relative to the shell and compressing the gasket means against the outer surface of the protrusion.

FIGURES OF THE DRAWINGS

Other advantages of the present invention will be readily appreciated as the same becomes better understood by reference to the following detailed description when considered in connection with the accompanying drawings wherein.

DETAILED DESCRIPTION OF THE DRAWINGS

Figure 1:
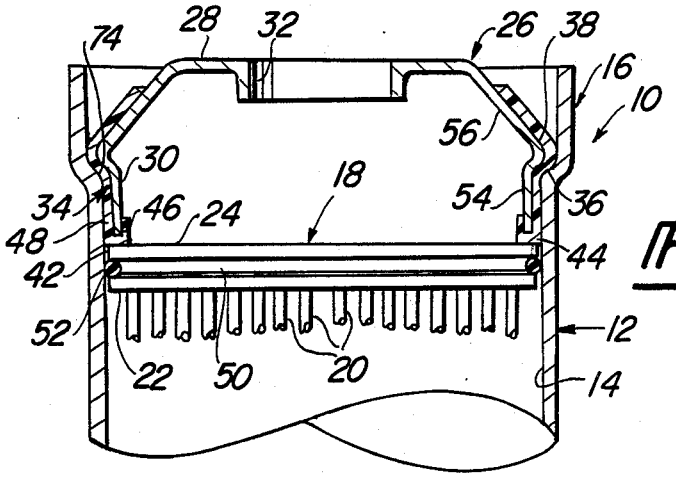
FIG. 1 is a cross sectional view of a heat exchange assembly constructed in accordance with the present invention, the end portion of the shell not being crimped.

A heat exchange assembly, commonly referred to as a shell and tube heat exchanger, is generally shown at 10 in drawings. Primed numbers are used to indicate like structure of the several embodiments shown.

The assembly 10 includes an outer shell generally indicated at 12. The shell 12 includes an internal passageway 14 defining a longitudinal axis of the shell 12. The shell 12 has an end portion, shown in each of the Figures, generally indicated at 16. A header plate 18 supports a plurality of tubes 20, generally connected to heat exchange fins or other elements, within the passageway 14. The header plate 18 has an inwardly facing surface 22 and outwardly facing surface 24. Generally, oils are contained inside the passageway 14 against the inner face 22 of the header plate 18 and water is contained within the end portions 16 of the shell against the outer face 24 of the header plate 18 and is conducted through the inner passages of the tubes 20. Heat is exchanged between the water passing through the tubes 20 and the oil outside the tubes 20 almost a plurality of each exchange fins or elements.

A cap member generally indicated at 26 is disposed within the end portion 16 of the shell 12. The cap member 26 includes a base portion 28 and annular wall portion 30 extending therefrom. The base portion 28 includes an opening 32 therethrough for connection to and fluid communication with the remainder of the water circulation system.

It is necessary to prevent water or any other fluid being used as a heat exchange fluid passing through the opening 32 to the tubes 20 from escaping and mixing with the oil within the inner passageway 14. In order to accomplish this goal while maintaining the economy of a solderless connection, the present invention includes connecting means for fixedly connecting the cap member 26 within the end portion 16 of the shell 12 without using solder or welds. A gasket, generally indicated at 34, perfects a fluid tight seal between the connecting means of the end portion 16 and the cap member 26. The cap member 26 includes a radially outwardly protecting protrusion having an axially inwardly facing surface 36 and an axially outwardly facing surface 38. The gasket 34 is disposed about the surfaces 36,38 of the protrusion. The connecting means includes a crimped part 40 disposed around the two surfaces 36,38 of the protrusion for preventing axially inward and outward movement of the cap member 26 relative to the shell 12 and compressing the gasket 34 against the outer surfaces 36,38 of the protrusion. In this manner, a solderless, weldless connection is perfected between the shell 12 and cap member 26 which retains the cap member 26 in place while also perfecting a seal between the shell and cap member 26. The crimped portion 40 pinches the gasket 34 against both faces 36,38 of the cap member 26 perfecting a seal heretofore not attainable.

More specifically, the protrusion is an annular radially outwardly projecting deformed portion of the cap member 26. Hence, the connecting means compressively engages the gasket 34 completely about the axially inwardly and outwardly facing portions 36,38. This configuration perfects a seal about the radial surface of the cap member thereby preventing seepage between the cap member 26 and end portion 16 of the shell 12.

The protrusion extends radially outwardly from the cylindrical portion 30 of the cap member 26. The gasket 34 extends about the protrusion and the substantial remainder of the cylindrical portion 30.

Figure 2:
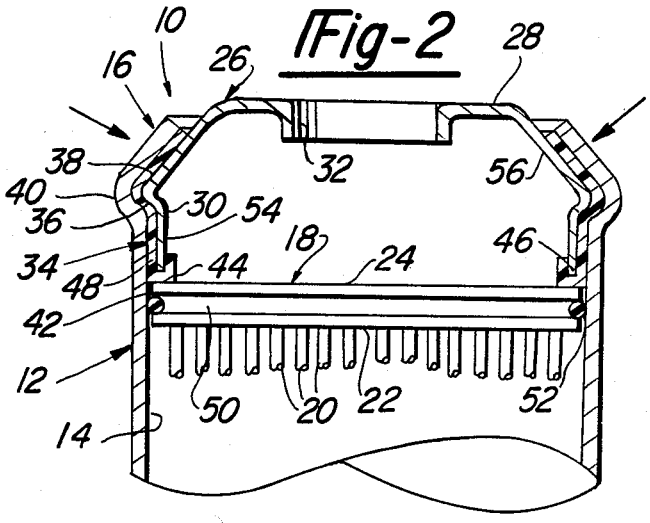
FIG. 2 is a cross sectional view of the assembly wherein the end portion of the shell is crimped about the protrusion extending from the cap member.

The connecting means is a deformed part 40 of the end portion 16 of the shell 12. The end portion 16 is actually crimped about the axially outwardly facing surface 38 of the protrusion. FIG. 1 shows the end portion 16 prior to crimping and FIG. 2 shows the end portion as crimped.

The header plate 18 includes an annular peripheral edge 42 extending thereabout. The assembly 10 further includes sealing means for perfecting a seal between the cylindrical portion 30 of the cap member 26 and the peripheral edge 42 of the header plate 18. The seal is perfected by an annular end portion 44 of the gasket 34. The annular end portion 44 is substantially U-shaped when viewed in cross section. The cylindrical portion 30 of the cap member 26 includes an annular peripheral edge 46 which is seated within the U-shaped end portion 44. The outer surface of the U-shaped end portion 44 engages the peripheral edge 42 of the header plate 18. The U-shaped end portion 44 has an outer leg 48 sandwiched between the cylindrical portion 30 and the end portion 16 of the shell 12. Thusly, a seal is perfected between the header plate 18, the cap member 26, and the shell 12. Since the crimped portion 40 prevents inward or outward movement of the cap member 26 relative to shell 12, the abutment of the U-shaped end portion 44 against the header plate 18 is maintained.

The U-shaped section 44 of the gasket 34 provides a solderless joint in combination with the header plate 18, the cap member 26, and the shell 12. Unlike prior art assemblies, the U-shaped section 44 of the gasket 34 has the ability of absorbing the differences in the rate of thermal expansion of the heat exchange element and outer shell, as these parts are typically fabricated from materials having different coeefficients of thermal expansion.

Second sealing means perfects a fluid tight seal between the header plate 18 and the shell 12. More specifically, the peripheral edge 42 of the header plate 18 includes an annular groove 50 extending thereabout. The second sealing means includes an O-ring 52 seated within the groove 50 and in sealing engagement with the inner wall of the shell 12.

In operation, the present invention provides three seals in combination with a connecting means four maintaining the cap member 26 within the inner passageway 24 of a shell 12 while perfecting the aforementioned seals. Water enters through the opening 32 within the passageway defined by the cap member 26 and through the tubes 20 in the header 18. Oil is maintained within the inner passageway 14 and against the inner face 22 of the header plate 18. The O-ring 52 prevents escape of oil from the inner passageway 14, the U-shaped portion 44 of the gasket 34 preventing escape of water. The seal perfected within the crimped portion 40 prevents outside air from entering the system.

The embodiment shown in FIGS. 1 and 2 includes a cap member 26 having a straight cylindrical end portion 54 adjacent the axially inwardly facing surface 36 and an inwardly slanting frustoconical portion 56 defining the axially outwardly facing portion 38.

Figure 3:
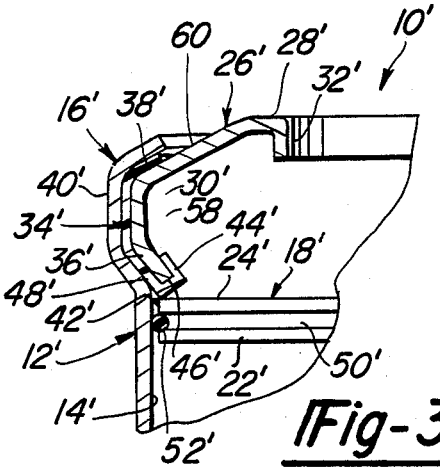
FIG. 3 is a fragmentary cross sectional view of a second embodiment of the present invention.

FIG. 3 shows an alternative embodiment wherein the cylindrical portion 30' of the cap member 26' includes an radially inwardly extending end portion defining the axially inwardly facing surface 36 and a cylindrical portion 58 adjacent thereto. A frustoconical portion 60 extends between the cylindrical portion 58 and the base portion 28' and includes the axially outwardly facing surface 38'.

Figure 4:
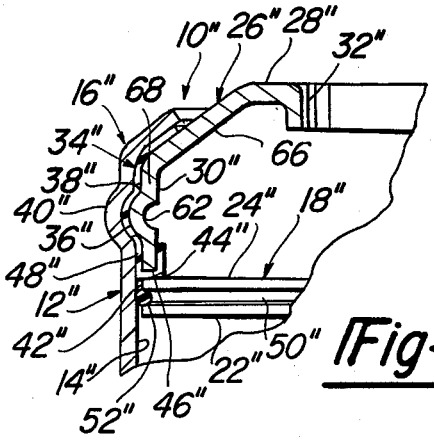
FIG. 4 is a fragmentary cross sectional view of a third embodiment of the present invention.
Figure 5:
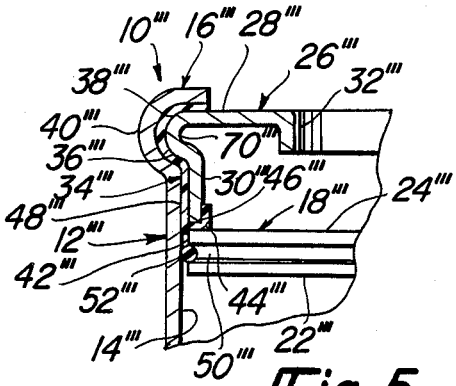
FIG. 5 is a fragmentary cross sectional view of a fourth embodiment of the present invention.

FIG. 4 shows a third embodiment of the invention wherein the protrusion is an annular outwardly annularly deformed portion 62. The end portion 16'' is crimped about the protrusion 62 and further about a frustoconical portion 66 extending between the base portion 28'' and a cylindrical 68 adjacent the protrusion 62.

FIG. 4 shows a fourth embodiment of the present invention wherein an annular protrusion 70 is directly adjacent to the base portion 28'''. The other end of the protrusion 70 is integral with a cylindrical portion 30'''.

The four embodiments of the present invention each include a protrusion having axially inwardly and outwardly facing surfaces 36,36',36'',36''', 40,40',40'',40''' functioning to perfect a seal between the cap member 26,26',26'', 26''' and the shell 12,12',12'',12'''. The protrusions further prevent the cap members 26,26',26'',26''' from axial movement relative to the shell 12,12',12'',12'''.

The present invention further provides a method of making the heat exchange assembly 10, generally including the steps of seating the axially inwardly facing surface 36 of the protrusion having the gasket 34 thereabout within the passageway 14 of the shell 12 against an outwardly extending seat 74 within the end portion 16 of the shell 12, as shown in FIG. 1. The end portion 16 of the shell 12 is crimped about the protrusion and gasket 34. Axially inward and outward movement of the cap member 26 relative to the passageway 14 is prevented and the gasket 34 is compressed completely about the outer surface of the protrusion to perfect a fluid tight seal between the shell 12 and the outer surface of the cap member 26.

More specifically, the end portion 26 of the shell 12 is deformed to conform to the outer surface of the deformed portions of the cap member 26 while clamping the gasket 34 therebetween. In this manner, the crimped end portion 26 is compressed to place the entire length of the gasket 34 about the protrusion in compression between the cap member 26 and shell 12.

Further, prior to crimping the end portion 26, the header plate 18 is inserted in the shell 12 and a seal is perfected between the periphery 42 of the header plate 18 and the edge 46 of the cap member 26 and the inner surface of the shell 12. This is accomplished by inserting the annular edge 46 of the cap member 26 into the end portion 44 of the gasket 34 which is U-shaped when viewed in cross section and abutting the U-shaped end portion 44 against the periphery 42 of the header plate 18 and against the inner wall of the shell 12 prior to crimping the end portion 16 of the shell 12.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

What is claimed:

1. A heat exchange assembly (10) comprising: an outer shell (12) including an internal passageway (14) defining a longitudinal axis and having an end portion (16); a cap member (26) disposed within said end portion (16), said shell (12) including connecting means for fixedly connecting said cap member (26) within said end portion (16); gasket means (34) for perfecting a fluid tight seal between said connecting means and said cap member (26); characterized by said cap member (26) including a radially outwardly projecting protrusion having an outer surface (36,38), said gasket means (34) being disposed about said protrusion, said connecting means including a crimped portion (40) around said protrusion for preventing axially inward and outward movement of said cap member (26) relative to said shell (12) and compressing said gasket means (34) against said outer surface (36,38) of said protrusion, said protrusion including an annular radially outwardly projecting deformed portion of said cap member (26), said annular deformed portion having substantially oppositely facing annular surfaces disposed at an angle relative to said longitudinal axis when viewed in longitudinal cross section, said connecting means compressively engaging said gasket means (34) completely about said annular surfaces.

2. A heat exchange assembly (10) comprising: an outer shell (12) including an internal passageway (14) defining a longitudinal axis and having an end portion (16); a cap member (26) disposed within said end portion (16), said shell (12) including connecting means for fixedly connecting said cap member (26) within said end portion (16); gasket means (34) for perfecting a fluid tight seal between said connecting means and said cap member (26); characterized by said cap member (26) including a radially outwardly projecting protrusion having an outer surface (36,38), said gasket means (34) being disposed about said protrusion, said connecting means including a crimped portion (40) around said protrusion for preventing axially inward and outward movement of said cap member (26) relative to said shell (12) and compressing said gasket means (34) against said outer surface (36,38) of said protrusion, said assembly including header plate means (18) for supporting a plurality of heat exchange tubes (20) within said shell (12), said header plate means (18) including a peripheral edge (42) thereabout, said assembly (10) further including sealing means for perfecting a seal between said cylindrical portion (30) of said cap member (28) and said peripheral edge (42) of said header plate means (18), said protrusion including an annular radially outwardly projecting deformed portion of said cap member (26), said annular deformed portion having an axially inwardly facing portion (36) and an outwardly facing portion (38) relative to said shell (12), said gasket means (34) being disposed over said outer surface of said axially inward and outward facing portions (36,38), said connecting means compressively engaging said gasket means (34) completely about said axially inwardly and outwardly facing portions (36,38), said cap member (26) including an annular base portions (28) and substantially cylindrical portion (30) extending axially therefrom, said protrusion extending radially outwardly from said cylindrical portion (30), said gasket means (34) extending about said protrusion and the remainder of said cylindrical portion (30), said connecting means being a deformed part (40) of said end portion (16) and said shell (12).

3. An assembly (10) as set forth in claim 2 further characterized by said gasket means (34) including an annular end portion (44) being substantially U-shaped when viewed in cross section, said cylindrical portion (30) including an annular peripheral edge (46) being seated within said U-shaped end portion (44), said U-shaped end portion (44) engaging said peripheral edge (42) of said header plate means (18) and having an outer leg (48) sandwiched between said cylindrical portion (30) and said end portion (16) of said shell (12) and perfecting a seal between said header plate means (18), said cap member (26), and said shell (12).

4. An assembly (10) as set forth in claim 3 further characterized by including sealing means for perfecting a fluid tight seal between said header plate means (18) and said shell (12).

5. An assembly (10) as set forth in claim 4 further characterized by said peripheral edge (42) of said header plate means (18) including an annular groove (50) extending thereabout, said sealing means including an O-ring (52) seated within said groove (50) and in sealing engagement with said shell (12).

* * * * *